US011834938B2

(12) United States Patent
Fu

(10) Patent No.: US 11,834,938 B2
(45) Date of Patent: Dec. 5, 2023

(54) METHODS OF PRESSURIZING A WELLBORE TO ENHANCE HYDROCARBON PRODUCTION

(71) Applicant: Xuebing Fu, Casper, WY (US)

(72) Inventor: Xuebing Fu, Casper, WY (US)

( * ) Notice: Subject to any disclaimer, the term of this patent is extended or adjusted under 35 U.S.C. 154(b) by 0 days.

(21) Appl. No.: 17/131,196

(22) Filed: Dec. 22, 2020

(65) Prior Publication Data

US 2021/0189853 A1 Jun. 24, 2021

Related U.S. Application Data

(60) Provisional application No. 62/978,587, filed on Feb. 19, 2020, provisional application No. 62/952,378, filed on Dec. 22, 2019.

(51) Int. Cl.
*E21B 43/26* (2006.01)
*E21B 43/08* (2006.01)

(52) U.S. Cl.
CPC ..... *E21B 43/26* (2013.01); *E21B 43/08* (2013.01); *E21B 43/2607* (2020.05)

(58) Field of Classification Search
CPC ..... E21B 33/12; E21B 43/08; E21B 43/10; E21B 43/14; E21B 43/26; E21B 43/2607
See application file for complete search history.

(56) References Cited

U.S. PATENT DOCUMENTS

| | | | | |
|---|---|---|---|---|
| 3,028,914 | A * | 4/1962 | Flickinger | E21B 43/26 166/284 |
| 10,208,547 | B2 * | 2/2019 | Kjorholt | E21B 43/14 |
| 2016/0145985 | A1 | 5/2016 | Weijian et al. | |
| 2017/0226834 | A1 * | 8/2017 | Ayasse | E21B 43/166 |
| 2017/0275978 | A1 * | 9/2017 | Ayasse | E21B 43/17 |
| 2017/0350222 | A1 * | 12/2017 | Gullickson | C09K 8/62 |
| 2019/0226309 | A1 | 7/2019 | Ayasse | |

OTHER PUBLICATIONS

International Search Report and Written Opinion issued in corresponding International Application No. PCT/US2020/070950 dated Mar. 8, 2021.

* cited by examiner

*Primary Examiner* — James G Sayre
(74) *Attorney, Agent, or Firm* — Norton Rose Fulbright US LLP

(57) ABSTRACT

Some methods of producing hydrocarbons from a formation include pressurizing a formation by pumping fluid into a portion of a wellbore having one or more first fractures in fluid communication with the formation, while the formation is pressurized, restricting fluid communication between the formation and the wellbore via the first fracture(s), and, while fluid communication between the formation and the wellbore via the first fracture(s) is restricted, producing hydrocarbons from the formation via one or more second fractures of the wellbore that are in fluid communication with the formation. Some methods include, while fluid communication between the formation and the wellbore via the first fracture(s) is restricted, creating the second fracture(s).

19 Claims, 11 Drawing Sheets

METHODS OF PRESSURIZING A WELLBORE TO ENHANCE HYDROCARBON PRODUCTION

CROSS-REFERENCE TO RELATED APPLICATIONS

This application claims the benefit of U.S. Provisional Patent Application No. 62/952,378, filed Dec. 22, 2019 and titled "REFRAC POST GAS INJECTION IN HORIZONTAL WELLS" and U.S. Provisional Patent Application No. 62/978,587, filed Feb. 19, 2020 and titled "REFRAC POST FLUID INJECTION IN HORIZONTAL WELLS," the entire contents of each of which are incorporated by reference herein.

FIELD OF INVENTION

The present invention relates generally to methods of producing hydrocarbons from a formation and, more specifically, to such methods in which one or more fractures of a wellbore are pressurized and subsequently isolated to enhance hydrocarbon production through one or more other fractures of the wellbore.

BACKGROUND

Hydrocarbon production became particularly significant over the last decade, especially from tight formations, with advances in horizontal drilling and multi-stage hydraulic fracturing. Despite such advances, however, primary recovery from tight formations remains low-in some instances, 90% or more of the formation's hydrocarbons are left in place.

To address this, post-primary recovery methods are sometimes used, but these methods typically have limited success. One such method is flooding between wellbores, in which a fluid (e.g., water and/or gas) is injected into a wellbore that is near the producing wellbore, in hopes that the fluid will "sweep" hydrocarbons from the formation into the producing wellbore where they can then be recovered. Often, however, the tight nature of the formation limits the fluid's ability to enter the formation from the injecting wellbore, or the fluid short-circuits to the producing wellbore (e.g., via fractures), leaving the formation unswept. Another post-primary recovery method is refracturing, in which new fractures are generated in the wellbore to increase access to the formation. But if the relevant portion of the formation is already pressure-depleted through the original fractures, such new fractures will usually not substantially increase hydrocarbon recovery from that portion. Cyclic gas injection, or "huff-and-puff," is another post-primary recovery method, which involves: (1) injecting gas into the wellbore to pressurize the formation's hydrocarbons and reduce their viscosity ("huff"); and (2) producing the energized fluid ("puff") through the wellbore. While huff-and-puff has had some success, results are inconsistent, it requires a large amount of gas, and its usage of the same is relatively inefficient.

Fracture-to-fracture flooding within a single wellbore has also been proposed as a post-primary recovery method, whether through simultaneous fluid injection into certain fractures and production from others, or fluid injection into certain fractures followed sequentially by production from others. Both options have shown positive results in simulations; an intra-wellbore fracture-to-fracture flooding pattern, particularly using a miscible gas, might lead to substantial hydrocarbon recovery. In practice, however, both require complex downhole tool systems and/or complex operations. For simultaneous injection and flooding, a dual-tubing system is needed, with a tubular to connect injection zones in the wellbore and a tubular to connect production zones in the wellbore, ensuring isolation between the injection and production zones. And for sequential injection and flooding, while a single tubular can be used, it needs to be opened and closed at each of the injection and production zones to ensure such isolation. Due, in part, to this tool-system requirement, neither simultaneous nor sequential intra-wellbore injection and production has had meaningful success.

SUMMARY

Some of the present methods, at least by pressurizing a formation by pumping fluid into a portion of a wellbore having one or more first fractures and subsequently isolating the first fracture(s), allow for enhanced, pressure-assisted hydrocarbon production through one or more second fractures of the wellbore with a reduced or eliminated need for complex tools, such as those that would be used for pre-injection isolation of the first fracture(s) (e.g., injection fractures) from the second fracture(s) (e.g., production fractures). The second fracture(s) can be created after the first fracture(s) are isolated, whether the second fracture(s) are created in the wellbore portion having the first fracture(s) and/or in another portion of the wellbore. And/or the second fracture(s) can be pre-existing and can receive fluid along with the first fracture(s) to pressurize the formation.

In embodiments in which the second fracture(s) are created after the first fracture(s) are isolated, additional benefits may be realized. For example, such may enhance flooding from the pressurized first fracture(s) to the new second fracture(s) and thus hydrocarbon recovery via the second fracture(s) using relatively basic isolation and fracturing operations. For further example, pressurizing the formation via the first fracture(s) may "heal" the formation, reducing the likelihood of the later-created second fracture(s) propagating toward—and short-circuiting with—the first fracture(s), issues with which are nevertheless at least in part mitigated by the formation being pressurized via the first fracture(s).

Some of the present methods of producing hydrocarbons from a formation comprise: pressurizing a formation by pumping fluid into a portion of a wellbore having one or more first fractures in fluid communication with the formation, while the formation is pressurized, restricting fluid communication between the formation and the wellbore via the first fracture(s), and, while fluid communication between the formation and the wellbore via the first fracture(s) is restricted, creating one or more second fractures in the wellbore that are in fluid communication with the formation, and producing hydrocarbons from the formation via the second fracture(s).

In some methods, the formation has an average permeability that is less than approximately 0.5 millidarcy (mD), optionally, less than approximately 0.1 mD. In some methods, the portion of the wellbore is horizontal.

In some methods, restricting fluid communication between the formation and the wellbore via the first fracture(s) is performed, at least in part, by disposing a tubular through the portion of the wellbore. In some methods, the tubular comprises a casing or a liner. In some methods, creating the second fracture(s) is performed, at least in part, by perforating the casing or liner. In some methods, creating the second fracture(s) is performed, at least in part, by using a sliding sleeve of the casing or liner. In some methods, packers are coupled to the tubular, and restricting fluid communication between the formation and the wellbore via the first fracture(s) is performed, at least in part, by setting the packers on opposing sides of the first fracture(s). In some methods, restricting fluid communication between the formation and the wellbore via the first fracture(s) is performed, at least in part, by pumping a fluid into the portion of the wellbore that at least partially seals the first fracture(s).

In some methods, at least one of the second fracture(s) is disposed between adjacent ones of the first fracture(s) in a direction along the wellbore. In some methods, a distance between the adjacent ones of the first fracture(s) is between 50 and 100 feet (ft).

In some methods, during pressurizing the formation and producing hydrocarbons from the formation, the fluid and the hydrocarbons flow through the wellbore or through a same tubular disposed within the wellbore. In some methods, during pressurizing the formation, pressure within the portion of the wellbore reaches a maximum pressure, and, when fluid communication between the formation and the wellbore via the first fracture(s) is restricted, pressure within the portion of the wellbore is within 20% of the maximum pressure. In some methods, the fluid comprises a majority, by volume and/or mass, of a gas.

Some of the present methods of producing hydrocarbons from a formation comprise: pressurizing a formation by pumping fluid into a portion of a wellbore having one or more first fractures in fluid communication with the formation, while the formation is pressurized, restricting fluid communication between the formation and the wellbore via the first fracture(s) at least by disposing a tubular through the portion of the wellbore and/or setting packers that are coupled to a (e.g., the) tubular on opposing sides of the first fracture(s), and, while fluid communication between the formation and the wellbore via the first fracture(s) is restricted, producing hydrocarbons from the formation via one or more second fractures of the wellbore that are in fluid communication with the formation. In some methods, the tubular comprises a casing or a liner. In some methods, the tubular includes one or more openings or opening sections that can be aligned with the second fracture(s). In some methods, at least one of the second fracture(s) is disposed between adjacent ones of the first fracture(s) in a direction along the wellbore.

In some methods, the formation has an average permeability that is less than approximately 0.5 mD, optionally, less than approximately 0.1 mD. In some methods, the portion of the wellbore is horizontal.

In some methods, during pressurizing the formation, pressure within the portion of the wellbore reaches a maximum pressure, and, when fluid communication between the formation and the wellbore via the first fracture(s) is restricted, pressure within the portion of the wellbore is within 20% of the maximum pressure. In some methods, the fluid comprises a majority, by volume and/or mass, of a gas.

Some of the present methods of producing hydrocarbons from a formation comprise: (1) injecting a fluid into a wellbore that is connected to one or more pre-existing ("Series I" or first) fractures; (2) blocking off the Series I fracture(s) from the wellbore; (3) creating one or more new ("Series II" or second) fractures in the wellbore on one side or both sides of any of the Series I fracture(s); and (4) producing hydrocarbons from the wellbore through the Series II fracture(s).

In some methods, a distance between adjacent ones of the Series I fracture(s) is between 30 and 2000 ft. In some methods, a distance between adjacent ones of the Series I and Series II fractures is between 15 and 1000 ft.

In some methods, the fluid comprises a gas and/or a liquid. In some methods, the fluid is continuously injected into the wellbore. In some methods, the fluid is discontinuously injected into the wellbore. In some methods, the composition of the fluid can change over time.

In some methods, blocking off the Series I fracture(s) is performed using diversion, one or more packers, one or more sleeves, one or more expandable liners, and/or one or more cemented liners.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified—and includes what is specified; e.g., substantially 90 degrees includes 90 degrees and substantially parallel includes parallel—as understood by a person of ordinary skill in the art. In any disclosed embodiment, the terms "substantially" and "approximately" may each be substituted with "within [a percentage] of" what is specified, where the percentage includes 0.1, 1, 5, and 10 percent.

The terms "comprise" and any form thereof such as "comprises" and "comprising," "have" and any form thereof such as "has" and "having," "include" and any form thereof such as "includes" and "including," and "contain" and any form thereof such as "contains" and "containing" are open-ended linking verbs. As a result, an apparatus that "comprises," "has," "includes," or "contains" one or more elements possesses those one or more elements but is not limited to possessing only those one or more elements. Likewise, a method that "comprises," "has," "includes," or "contains" one or more steps possesses those one or more steps but is not limited to possessing only those one or more steps.

Any embodiment of any of the apparatuses, systems, and methods can consist of or consist essentially of—rather than comprise/have/include/contain—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

Further, an apparatus, system, or method that is configured in a certain way is configured in at least that way, but it can also be configured in other ways than those specifically described.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers.

DETAILED DESCRIPTION

Figure 1:
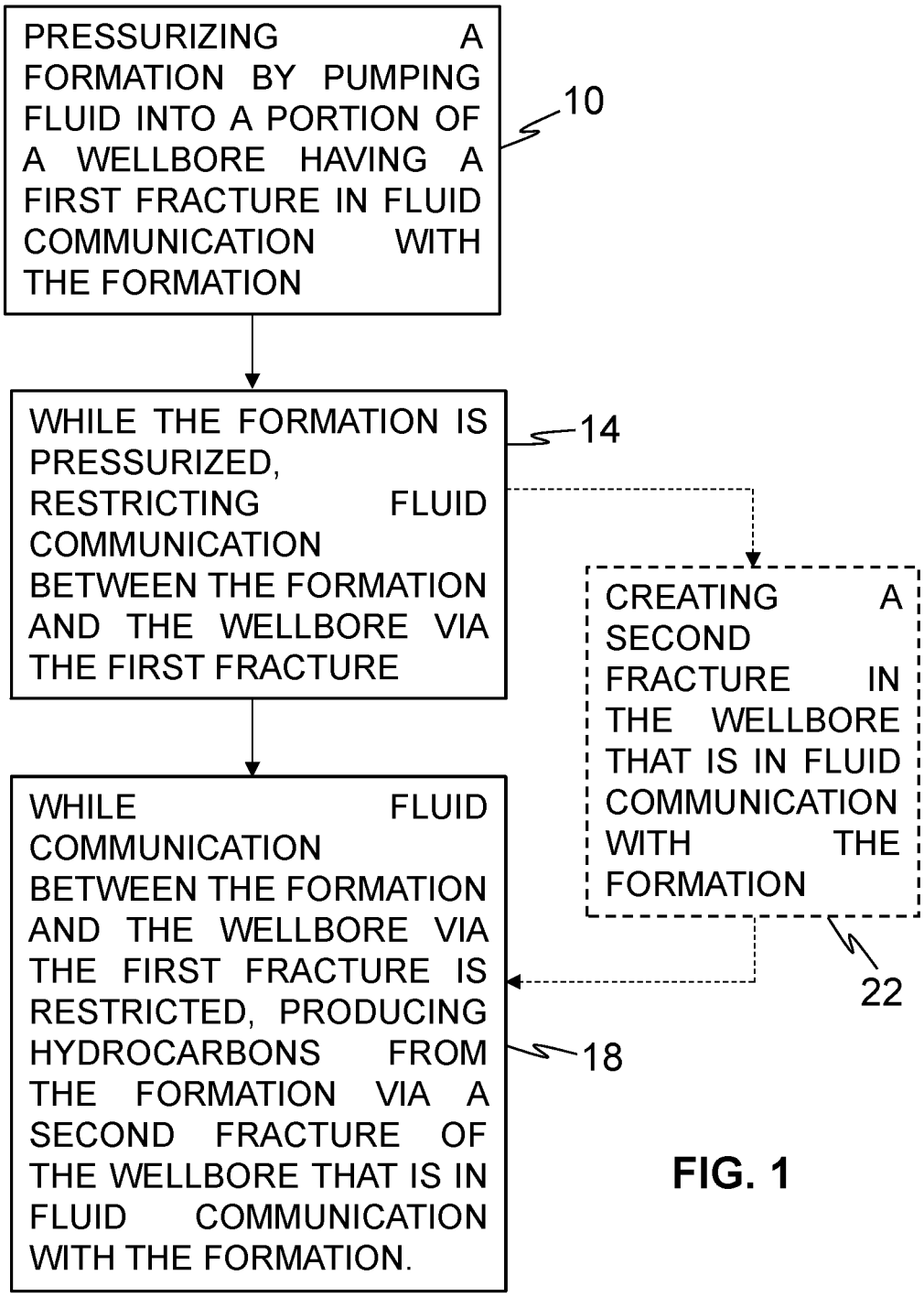
FIG. 1 is a flowchart depicting some of the present methods, which include pressurizing a formation via one or more first fractures of a wellbore, restricting fluid communication between the formation and the wellbore via the first fracture(s), and producing hydrocarbons from the formation via one or more second fractures of the wellbore.
Figure 2A:
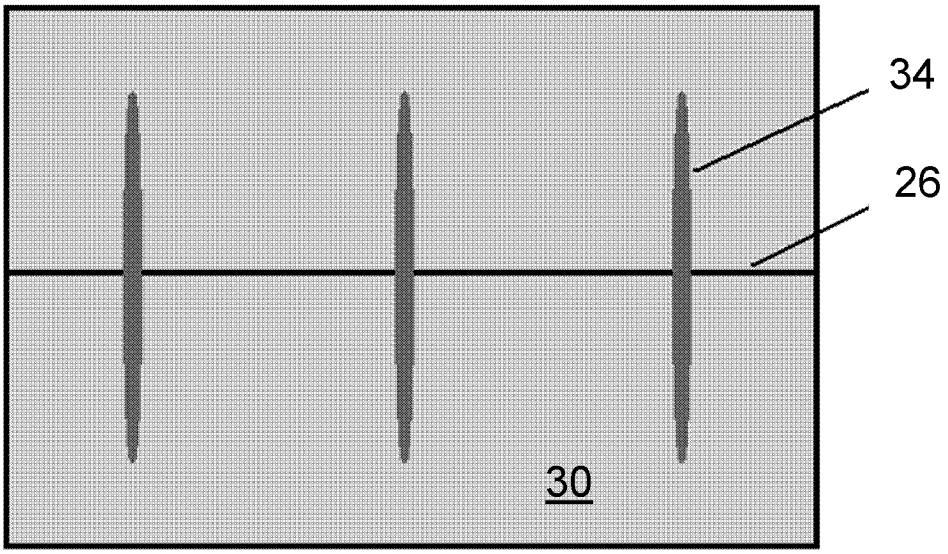
FIG. 2A is a schematic of a wellbore having pre-existing fractures in communication with a formation.
Figure 2B:
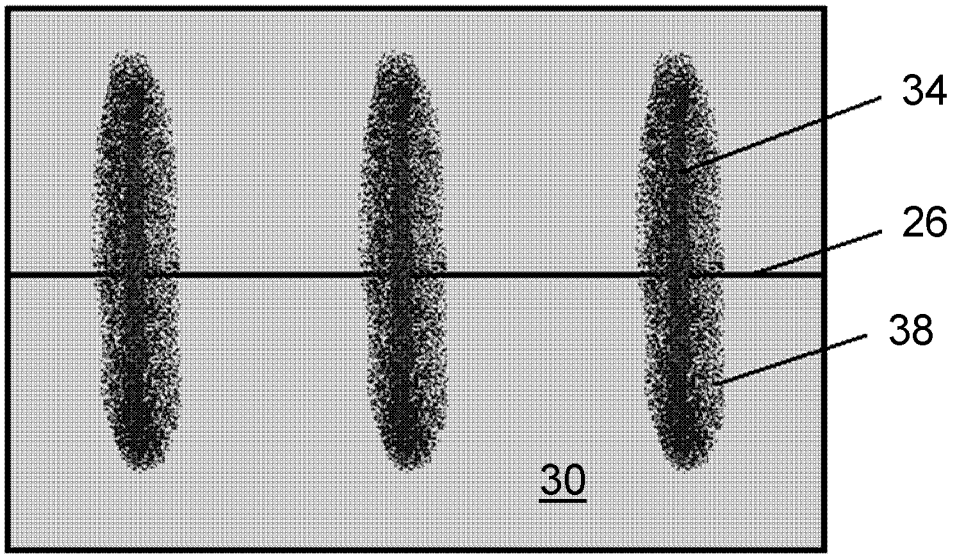
FIG. 2B is a schematic of the wellbore of FIG. 2A, shown during pressurization of the formation via the pre-existing fractures.
Figure 2C:
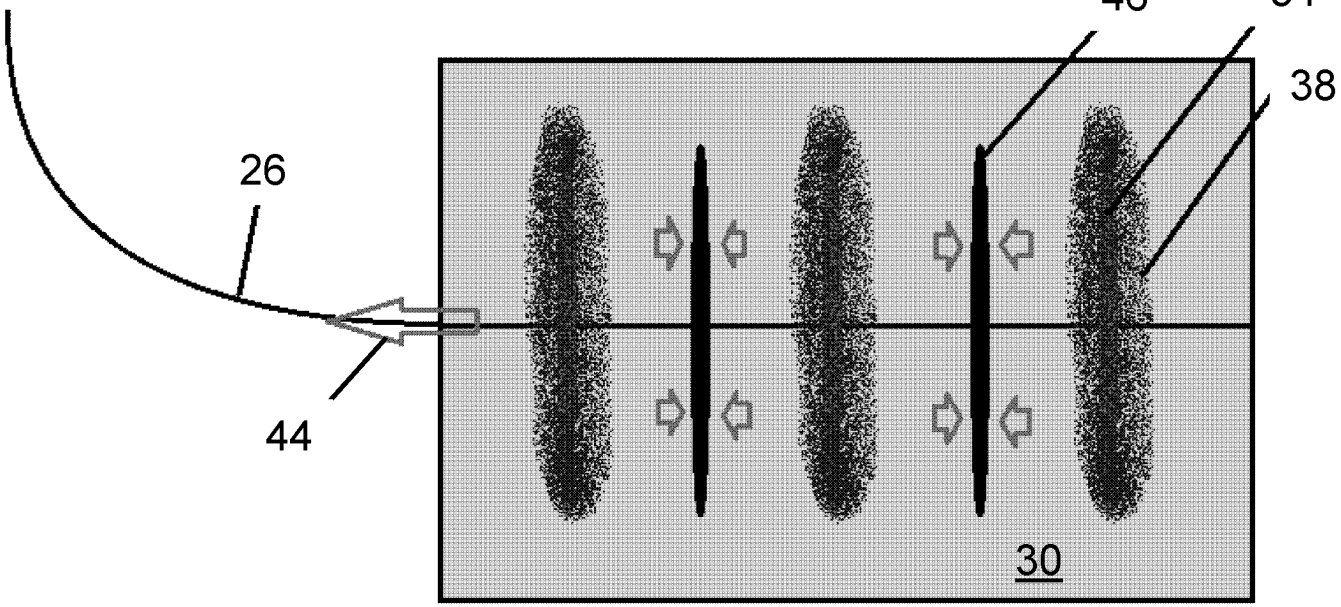
FIG. 2C is a schematic of the wellbore of FIG. 2B, shown with fluid communication between the formation and the wellbore via the pre-existing fractures being restricted and during production of hydrocarbons from the formation via new fractures of the wellbore.

FIG. 1 is a flowchart depicting some of the present methods of producing hydrocarbons from a wellbore, and FIG. 2A is a schematic of a wellbore 26 that is used to illustrate steps of some of those methods, the wellbore being drilled into a formation 30 and having fractures 34 in fluid communication the formation. As shown in FIG. 2B, some methods include a step 10 of pressurizing a formation (e.g., 30) by pumping fluid (e.g., 38) into a portion (e.g., 42) of a wellbore (e.g., 26) that has one or more first fractures (e.g., 34) in fluid communication with the formation. In some methods, at step 14, fluid communication between the formation and the wellbore via the first fracture(s) is then restricted to mitigate pressure loss from the formation via the first fracture(s), as shown in FIGS. 2B and 2C. And as shown in FIG. 2C, some methods include a step 18 of producing, assisted by the formation's pressurization, hydrocarbons (e.g., 44) through one or more second fractures (e.g., 46) of the wellbore that are in fluid communication with the formation. In some methods, prior to step 18, the second fracture(s) are created in the wellbore at step 22. These steps and their corresponding structures are described in more detail below.

Figure 3A:
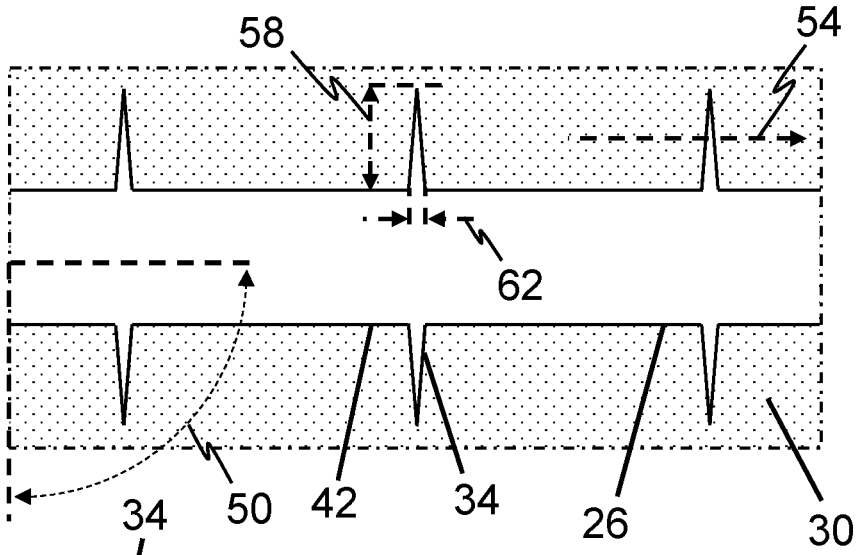
FIG. 3A is a schematic of a wellbore having first fractures in fluid communication with a formation.

Referring now to FIG. 3A, shown is another example wellbore 26 upon which the present methods can be performed, the wellbore being drilled into a formation 30 and having first fractures 34 in fluid communication with the formation. Provided by way of illustration, formation 30 can have an average permeability that is less than approximately 5.0 mD, such as an average permeability that is less than or equal to any one of, or between any two of: 5.0, 4.5, 4.0, 3.5, 3.0, 2.5, 2.0, 1.5, 1.0, 0.9, 0.8, 0.7, 0.6, 0.5, 0.4, 0.3, 0.2, 0.1, 0.75, 0.50, 0.25, 0.10, 0.075, 0.05, 0.025, 0.01, 0.0075, 0.005, 0.0025, 0.001, 0.00075, 0.0005, 0.00025, 0.0001, 0.000075, 0.00005, or 0.000025 mD. The present methods may be particularly effective on tight formations where hydrocarbon recovery from primary and traditional post-primary recovery methods was or would be low, such as formations having an average permeability that is less than 0.1, 0.01, 0.001, or 0.0005 mD.

Wellbore 26 can be a horizontal wellbore. To illustrate, a portion 42 of wellbore 26 can have an inclination angle 50 that is at least 80 or 85 degrees, can be a "lateral" as that term is understood in the art, and/or the like. The length of wellbore portion 42 can be, for example, greater than or equal to any one of, or between any two of: 100, 200, 500, 1,000, 2,000, 3,000, 5,000, 7,500, 10,000, 15,000, 20,000, or 30,000 ft. Wellbore portion 42 can be drilled along a direction of minimum horizontal stress 54 in formation 30 (e.g., within 45, 40, 35, 30, 25, 20, 15, or 10 degrees of that direction), which encourages the fractures to propagate orthogonally to the wellbore portion. In some cases, however, other considerations may weigh against drilling wellbore portion 42 in the direction of minimum horizontal stress. To illustrate, spacing units are often rectangular, with sides that run in the north-south and east-west directions, and to better utilize such spacing units, wellbores associated with them are typically drilled in those directions, which may not align with the direction of minimum horizontal stress. The present methods can nevertheless be used on such wellbores, with the understanding that is preferred if their fractures are distinct from one another to facilitate pressurization and subsequent isolation of some of the fractures and production from others of the fractures.

As shown, wellbore portion 42 is open-hole, having no casing or liner at the wellbore-formation interface. In other embodiments, however, a wellbore portion (e.g., 42), or at least a section thereof, can be cased or lined (e.g., like FIG. 3C's casing or liner 66, but in place prior to pressurizing the formation at step 10).

Wellbore portion 42 is illustrated with three first fractures 34, but other numbers of first fractures—1, 2, 4, 5, 6, 7, 8, 9, 10, or more—are also suitable. First fractures 34 can be created via hydraulic fracturing, in which a fracturing fluid (e.g., comprising water, a friction-reducer, a polymer, a cross-linker, a gel, a foam, an oil-based fluid, a surfactant, and/or the like) is injected into wellbore portion 42 at a high enough pressure to fracture formation 30, in some instances, at previously-created perforations in the wellbore portion (e.g., through a casing or a liner, as illustrated in FIG. 3D). A proppant, such as sand, ceramic particles, and/or the like, can then be pumped into first fractures 34 to keep them open and thereby provide flow paths between wellbore portion 42 and formation 30 for injection and production.

The dimensions of first fractures 34 will depend on a variety of circumstances, including the type of fracturing fluid used, the type of proppant used, the injection rate and pressure used, and formation 30's properties. Provided by way of illustration, a first fracture 34 can have a height 58, measured from wellbore portion 42 to the fracture's tip, that is from a few feet (e.g., 2-3 ft) to a few thousand feet (e.g., 2,000-3,000 ft). And a first fracture 34 can have a width 62, driven largely by the size and the packing of the proppant used, that is on the order of a thousandth of a foot. First fractures 34 are depicted as biwing planar fractures, but more complex first fractures are also suitable, such as those that extend into formation 30 in multiple directions to form a three-dimensional fracture network. Such complex fractures may be less ideal than bi-wing planar fractures in forming desirable flood patterns, but the present methods can still be effective.

A distance 64 (labeled in FIG. 3B) between adjacent ones of first fractures 34, measured along wellbore portion 42, can be greater than or equal to any one of, or between any two of: 10, 15, 20, 25, 30, 35, 40, 45, 50, 60, 70, 80, 90, 100, 125, 150, 175, 200, 225, 250, 275, 300, 350, 400, 450, 500, 550, 600, 650, 700, 750, 800, 850, 900, 950, 1,000, 1,100, 1,200, 1,300, 1,400, 1,500, 1,600, 1,700, 1,800, 1,900, or 2,000 ft, with illustrative distances including 30, 45, 60, 90, 120, 150, 200, 300, 400, 500, 600, 800, 1,000, 1,500, and 2,000 ft. Distance 64 can, but need not, be substantially the same for different pairs of adjacent ones of first fractures 34. In some wellbores, first fractures 34 may be disposed in clusters; for such wellbores, distance 64 is measured between adjacent ones of the clusters.

To facilitate its pressurization via first fractures 34 at step 10, a smaller distance 64 is generally preferred for a formation 30 having a lower average permeability. Non-limiting examples of wellbores that may be particularly suited for use with the present methods include those having the initial fracture spacings (distances 64) and average formation permeabilities in TABLE 1, below.

Wellbore portion 42 and one or more of its first fractures 34 can be pre-existing, one or more first fractures 34 can be created in the wellbore portion as part of the present methods, and/or the wellbore portion can be drilled and the first fractures can be created as part of the present methods. To illustrate, the present methods encompass creating one or more additional first fractures 34 in a pre-existing wellbore portion 42 having one or more pre-existing first fractures 34, enhancing (e.g., via refracturing) one or more of the pre-existing first fracture(s), drilling the wellbore portion (e.g., from a pre-existing vertical wellbore, by extending a pre-existing lateral of a wellbore, or the like) and subsequently creating the first fractures, and/or the like. When first fractures 34 are created as part of the present methods, distances 64 between the first fractures can be selected to enhance formation 30's pressurization (at step 10) based on, for example, the formation's average permeability as described above, increasing subsequent hydrocarbon recovery (at step 18).

In any of the above scenarios, wellbore portion 42 can, but need not, be produced via traditional primary recovery until a threshold is reached, such as, for example, the hydrocarbon recovery rate drops to near or below a limit, formation 30 pressure falls below a certain level, and/or the like, after which the present methods can begin (or resume) by pressurizing the formation at step 10. Also prior to step 10's pressurization step, primary recovery and/or one or more post-primary recovery methods (e.g., huff-and-puff, refracturing) can, but need not, be used.

Figure 3B:
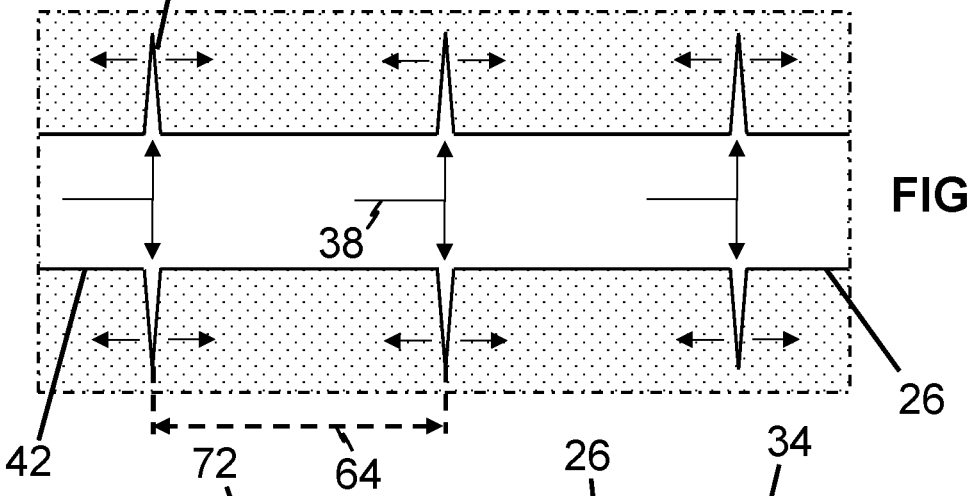
FIG. 3B is a schematic of the wellbore of FIG. 3A, shown during pressurization of the formation via the first fractures.

Turning now to FIG. 3B, formation 30 can be pressurized at step 10 by pumping fluid 38 into wellbore portion 42. As shown, once in wellbore portion 42, fluid 38 flows into and thereby pressurizes formation 30 via first fractures 34 (and, in some methods, via second fractures 46 as described below). Fluid 38 can comprise a liquid, a gas, or a combination of both, and the composition of the fluid can change over the course of injection. Non-limiting examples of suitable gasses for fluid 38 include methane, other hydrocarbon gasses, nitrogen, carbon dioxide, and/or the like, which desirably are miscible, and non-limiting examples of suitable liquids for the fluid include water as well as any solutions, emulsions, suspensions, or mixtures that are used for water flooding and/or preventing post-fluid-injection kicks. For at least some formations (e.g., 30), gas is preferred for use as the injection fluid (e.g., 38) due, in part, to its enhanced ability to enter the formation and its compressibility; to illustrate, in some methods, fluid 38, for at least a portion of step 10, comprises a majority, by volume (determined at the pressure at which the fluid is injected, measured at the surface, into the formation) and/or mass, of a gas.

During pumping, wellbore portion 42 can be in fluid communication with substantially all of—up to and including all of—the remainder of wellbore 26 or at least its horizontal portion, such that substantially all of the wellbore or its horizontal portion is pressurized along with the wellbore portion. At least by minimizing the need for isolation between wellbore portions, this can provide advantages in terms of simplicity and cost. Wellbore portion 42 can, however, be isolated from at least one other portion of wellbore 26 during pumping, such as, for example, via packers (e.g., 70, FIG. 4A) disposed on opposing sides of the wellbore portion or other wellbore portion. This may be advantageous when, for example, formation 30 around the other wellbore portion is unsuitable for fluid injection, contains insufficient hydrocarbons, will not be produced from, and/or the like. In either event, the present methods do not require pre-injection isolation of certain fractures for injection from other fractures for production and thereby provide for more practical intra-wellbore fracture-to-fracture flooding with a reduced or eliminated need for complex tools.

During pressurization of formation 30 at step 10, pressure within wellbore portion 42 can reach or exceed a target or threshold pressure, such as, for example, a pressure that is substantially equal to a minimum miscibility pressure associated with formation 30, a pressure that is substantially equal to an initial reservoir pressure associated with the formation, or the like, which can then be substantially maintained or varied over time. In general, a higher target or threshold pressure may enhance mixing of fluid 38 with hydrocarbons in formation 30, and a lower target or threshold pressure may reduce costs associated with pressurizing the formation. In some methods, step 10's injecting can be performed (e.g., substantially continuously) for a period of time that is greater than or equal to any one of, or between any two of: 1 week, 2 weeks, 1 month, 3 months, 6 months, 1 year, 2 years, or 4 years. Pressurizing of formation 30 at step 10 can end when, for example, an injection rate of fluid 38 into wellbore portion 42 falls below a target or threshold rate, a target amount of fluid has been injected, or the like.

Figure 3C:
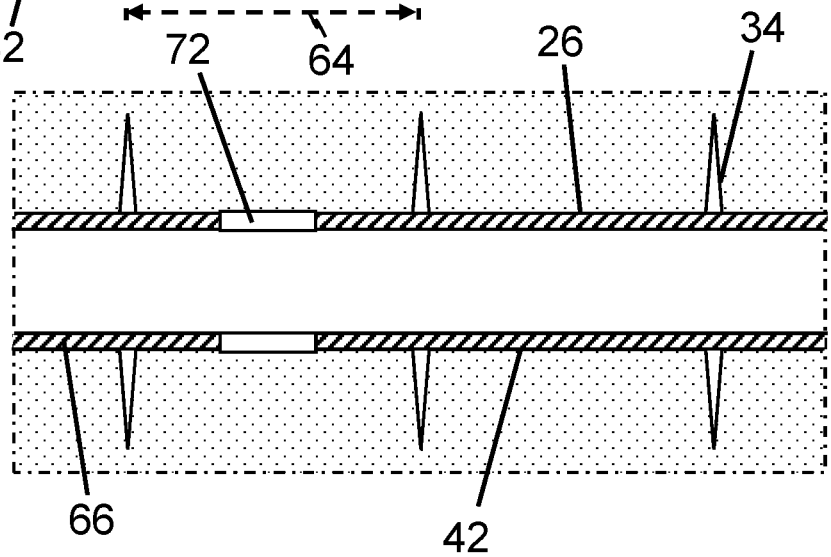
FIG. 3C is a schematic of the wellbore of FIG. 3B, shown with fluid communication between the formation and the wellbore via the first fractures being restricted using a casing or a liner.
Figure 3D:
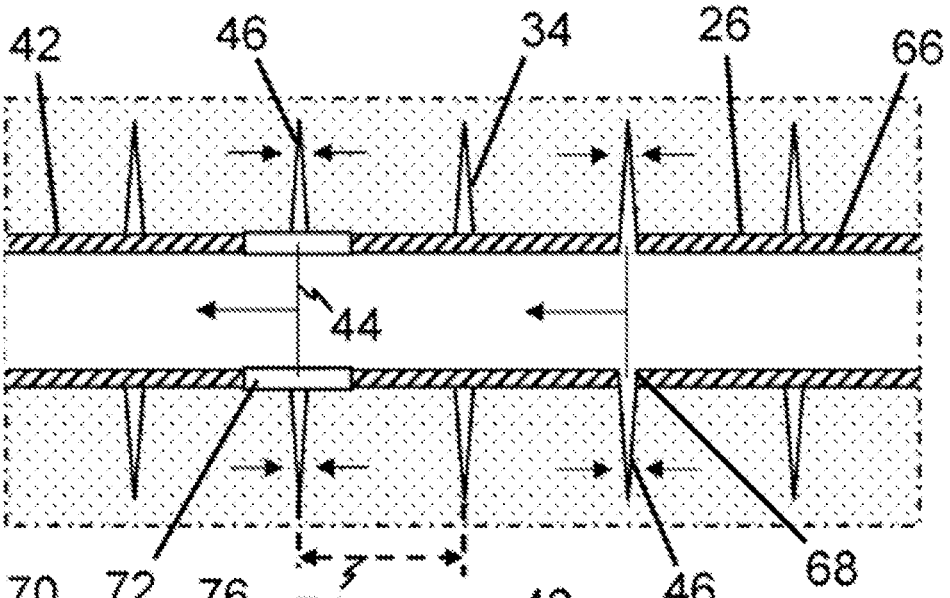
FIG. 3D is a schematic of the wellbore of FIG. 3C, shown during production of hydrocarbons from the formation via second fractures of the wellbore that were created, at least in part, by perforating the casing or the liner.

Referring now to FIG. 3C, with formation 30 pressurized, fluid communication between the formation and the wellbore via first fractures 34 can be restricted at step 14. To facilitate maintenance of pressure in wellbore portion 42 as first fractures 34 are isolated, depending on the method of isolating the first fractures, a high-density fluid can be pumped into the wellbore portion, a plug, packer, or other tool can be set upstream of the wellbore portion, pumps used to pressurize formation 30 can continue to run (e.g., steps 10 and 14 can be performed, at least in part, concurrently), a snubbing unit can be used, and/or the like. To illustrate, in some methods, during step 14, pressure within wellbore portion 42 is within 25, 20, 15, 10, or 5% of the target or threshold pressure for step 10 or a maximum pressure within the wellbore portion reached during step 10.

Step 14's restricting fluid communication between formation 30 and wellbore 26 via first fractures 34, or isolating the first fractures, can be performed in any of a variety of ways, including those that restrict fluid communication from the first fractures to wellbore portion 42 (e.g., using FIG. 3C's casing or liner 66, FIG. 5A's fluid 82, or the like), those that restrict fluid communication from the wellbore portion to other portions of the wellbore (e.g., using FIG. 4A's packers 70), and/or the like. Illustrative such options and their impact on remaining steps of the present methods—producing hydrocarbons 44 from second fractures 46 of wellbore 26 (step 18) and, optionally, creating the second fractures (step 22)—are described below.

As illustrated in FIG. 3C, for example, a tubular in the form of a casing or liner 66 can be disposed through wellbore portion 42 at step 14, such that the casing or liner overlies first fractures 34 and thereby seals them from the wellbore portion. Casing or liner 66 can be cemented into wellbore portion 42 (e.g., if a casing) or expanded to engage the wellbore portion (e.g., if a liner). If wellbore portion 42 has a casing or liner existing prior to step 14, casing or liner 66 can be installed over the pre-existing casing or liner. In either case, wellbore portion 42 may be cleaned prior to installing the casing or liner to facilitate the same.

Continuing with this example, and as shown in FIG. 3D, second fractures 46 can then be created in wellbore 26 at step 22. Any number of second fractures 46 can be created (e.g., 1, 2, 3, 4, 5, 6, 7, 8, 9, 10, or more second fractures), which can be achieved via hydraulic fracturing as described above for first fractures 34. Second fractures 46 can propagate from perforations 68 in wellbore 26 (e.g., created using a perforating gun and/or a jetting tool, such as in sand jet perforating) that can—but need not—extend through casing or liner 66 as shown, and/or the second fractures can be created by flowing fracturing fluid through ports of a sliding sleeve 72 (e.g., of the casing or liner 66).

Second fractures 46 can be created in wellbore portion 42 and/or or in one or more other portions of wellbore 26, such as those upstream or downstream of wellbore portion 42. To illustrate, at least one of second fractures 46 can be disposed between adjacent ones—or adjacent clusters of—first fractures 34 in wellbore portion 42. In this way, a distance 74 between adjacent ones of the first and second fractures, or clusters of the same, can be, for example, greater than or equal to any one of, or between any two of: 5, 10, 15, 20, 25, 30, 35, 40, 45, 50, 60, 70, 80, 90, 100, 125, 150, 175, 200, 225, 250, 275, 300, 350, 400, 450, 500, 550, 600, 650, 700, 750, 800, 850, 900, 950, or 1,000 ft, with illustrative distances including 15, 25, 30, 45, 60, 75, 100, 150, 200, 250, 300, 400, 500, 750, and 1,000 ft. Distance 74 can, but need not, be substantially the same for different pairs of adjacent ones or adjacent clusters of first fractures 34 and second fractures 46. Wellbore portion 42's final fracture spacings (e.g., distances 74) can be selected based, at least in part, on the wellbore portion's initial fracture spacings (e.g., distances 64) and/or formation 30's average permeability. Exemplary final fracture spacings are provided in TABLE 1, below, for various such initial fracture spacings and formation average permeabilities.

Like first fractures 34, second fractures 46 can be biwing planar fractures (as depicted) and/or complex fractures, and a second fracture 46 can have the illustrative dimensions described above for a first fracture 34. Particularly when using smaller spacings (e.g., distances 74) between first fractures 34 and second fractures 46, biwing planar fractures may be preferred in order to mitigate first-to-second fracture connections.

Step 22—creating second fractures 46 in wellbore 26—is optional; in some methods, one or more of (e.g., all of) the second fractures are pre-existing. In such methods, pre-existing second fractures 46 can be pressurized along with first fractures 34 at step 10, but not isolated like the first fractures at step 14, so that hydrocarbons 44 can be produced from formation 30 via those second fractures at step 18. In this way, hydrocarbons can be produced through the second fractures, assisted by both pressurization of the first fractures and huff-and-puff.

Continuing with FIG. 3D, at step 18, hydrocarbons 44 can then be produced from formation 30 via second fractures 46. Due to formation 30's pressurization (step 10), such production can be greatly enhanced compared to that achievable through primary or other post-primary recovery methods. To illustrate, the present methods can provide for a hydrocarbon recovery percentage that is up to 100% or more of a hydrocarbon recovery percentage obtained during primary recovery (TABLE 1, below).

Step 18's hydrocarbons 44 and step 10's fluid 38 can share a flow path through wellbore 26. For example, fluid 38 can flow from the surface and into wellbore portion 42 along a flow path, hydrocarbons 44 can flow from the wellbore portion and to the surface along a flow path, and the hydrocarbons' flow path—along at least a majority of, substantially all of, or all of its length—can be the same as the fluid's flow path, meaning it is bounded by the same wellbore 26 portions, casing or liner 66 portions, or other tubular portions. This is another way in which the present methods can provide for intra-wellbore fracture-to-fracture flooding with a reduced or eliminated need for complex tools and/or complex operations.

Figure 4A:
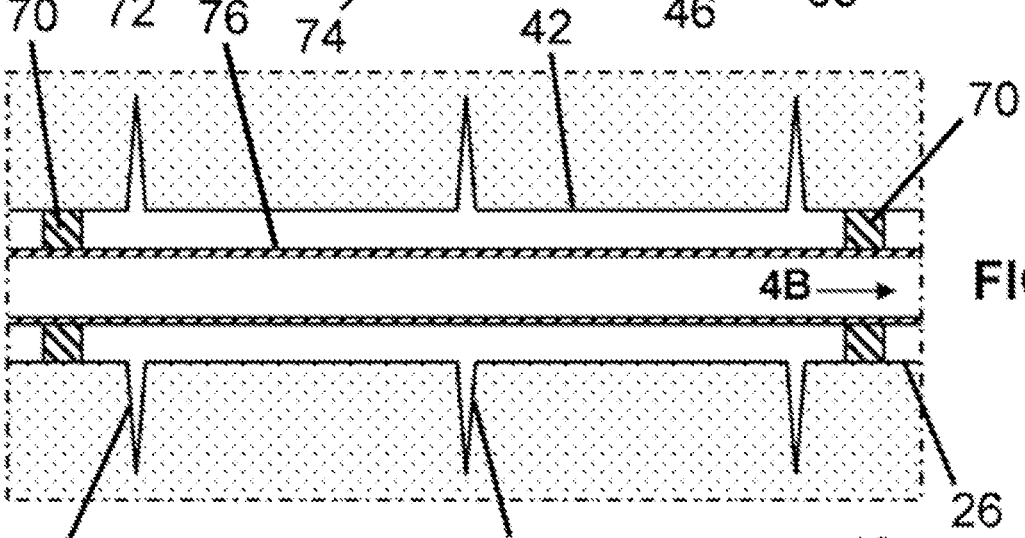
FIG. 4A is a schematic of the wellbore of FIG. 3B, shown with fluid communication between the formation and the wellbore via the first fractures being restricted using packers coupled to a tubular.
Figure 4B:
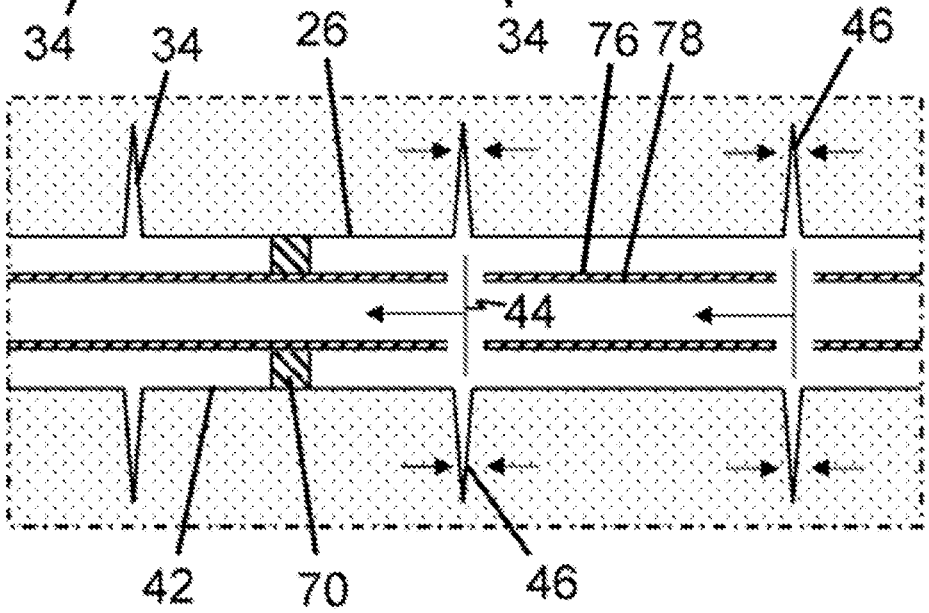
FIG. 4B is a schematic of the wellbore of FIG. 4A, shown during production of hydrocarbons from the formation via second fractures of the wellbore that were created, at least in part, using sliding sleeves.

Referring now to FIGS. 4A and 4B, shown is another option for isolating first fractures 34 at step 14. In this example, after first fractures 34 are pressurized at step 10, a tubular 76 coupled to packers 70 can be disposed within wellbore portion 42, and the packers can be set on opposing sides of the first fractures, thereby isolating them. To facilitate production of hydrocarbons 44 (step 18) from a wellbore portion downstream of first fractures 34, tubular 76 can include a passageway 78 through which such hydrocarbons can flow. As shown, second fractures 46 are disposed on only one side of—rather than between—first fractures 34. Such placement of first and second fractures, 34 and 46, can be used in any of the methods described above; likewise, any of the first and second fracture placements described above can be used in FIGS. 4A and 4B's example. While second fractures 46 are shown as pre-existing, in otherwise similar methods, the second fractures can be created at step 22 as described above.

Figure 5A:
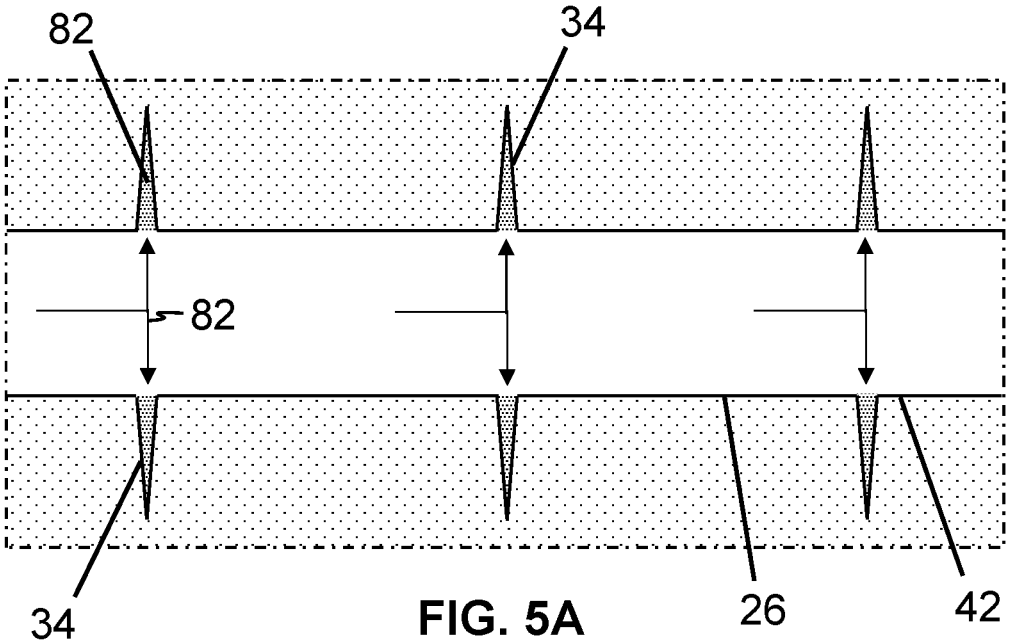
FIG. 5A is a schematic of the wellbore of FIG. 3B, shown with fluid communication between the formation and the wellbore via the first fractures being restricted using a diverter fluid.
Figure 5B:
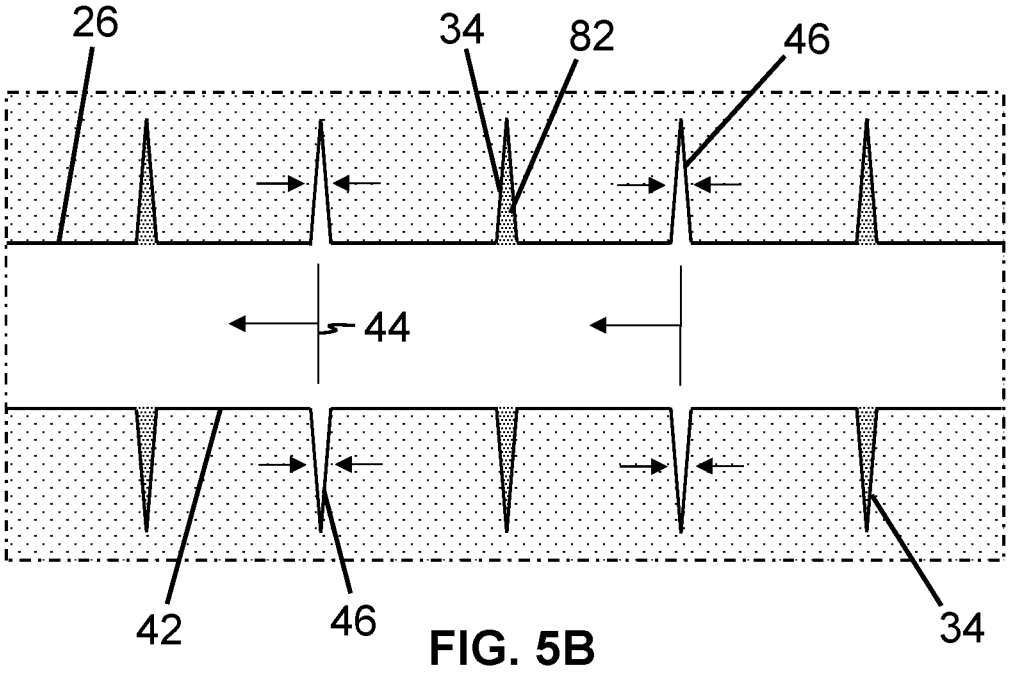
FIG. 5B is a schematic of the wellbore of FIG. 5A, shown during production of hydrocarbons from the formation via second fractures of the wellbore.
Figure 6A:
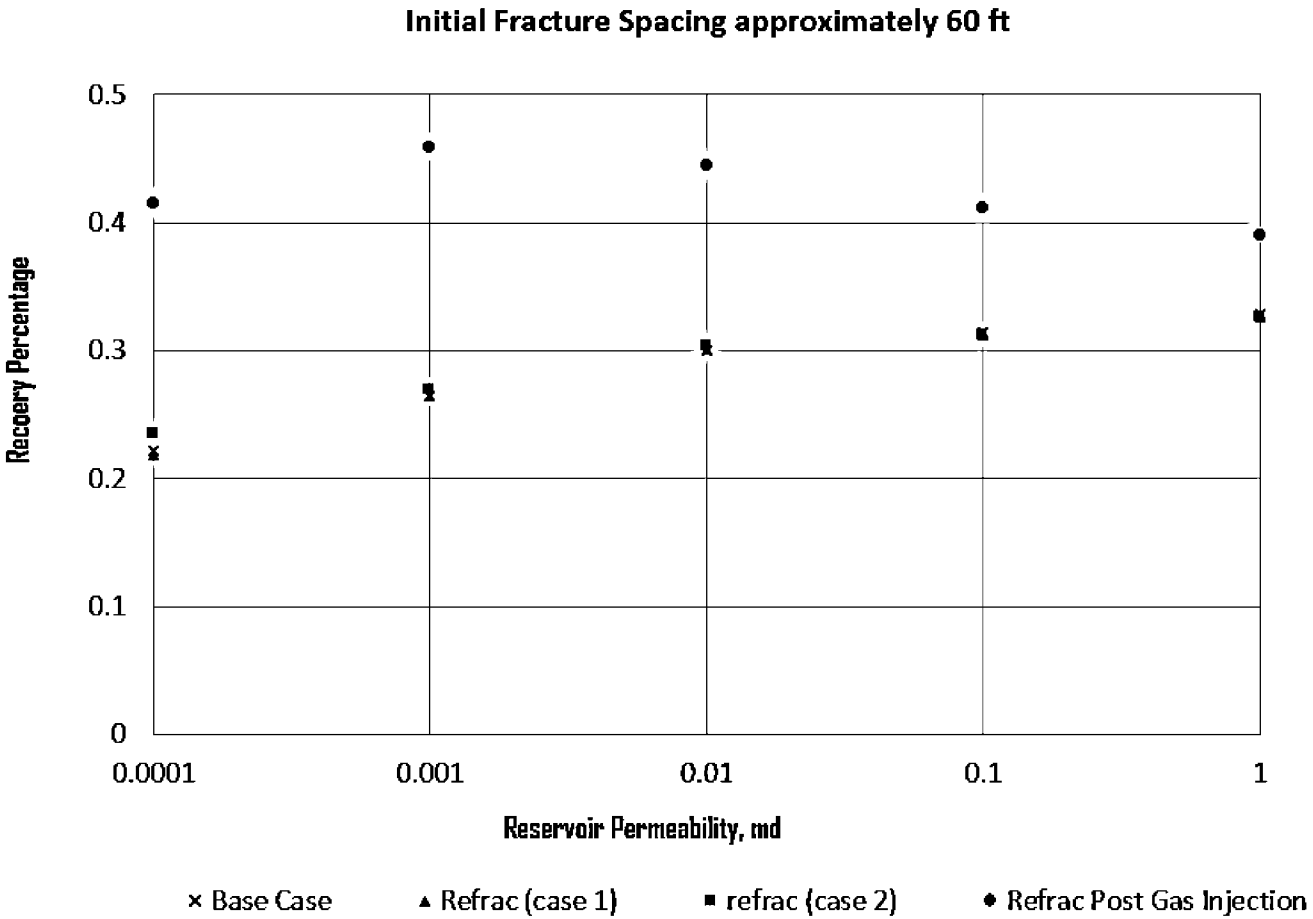
FIGS. 6A-6E are each a chart showing simulated hydrocarbon recovery percentages for a fractured wellbore as a function of formation permeability for: (1) production from the initial fractures of the wellbore ("Base Case"); (2) production from additional fractures of the wellbore after it is refractured ("Refrac"), without ("case 1") and with ("case 2") production from the initial fractures; and (3) production from additional fractures of the wellbore when the initial fractures are pressurized and isolated and the wellbore is refractured ("Refrac Post Gas Injection"), where (1)-(3) have a spacing between the initial fractures that is approximately 60, 120, 240, 480, or 960 ft, respectively.
Figure 6B:
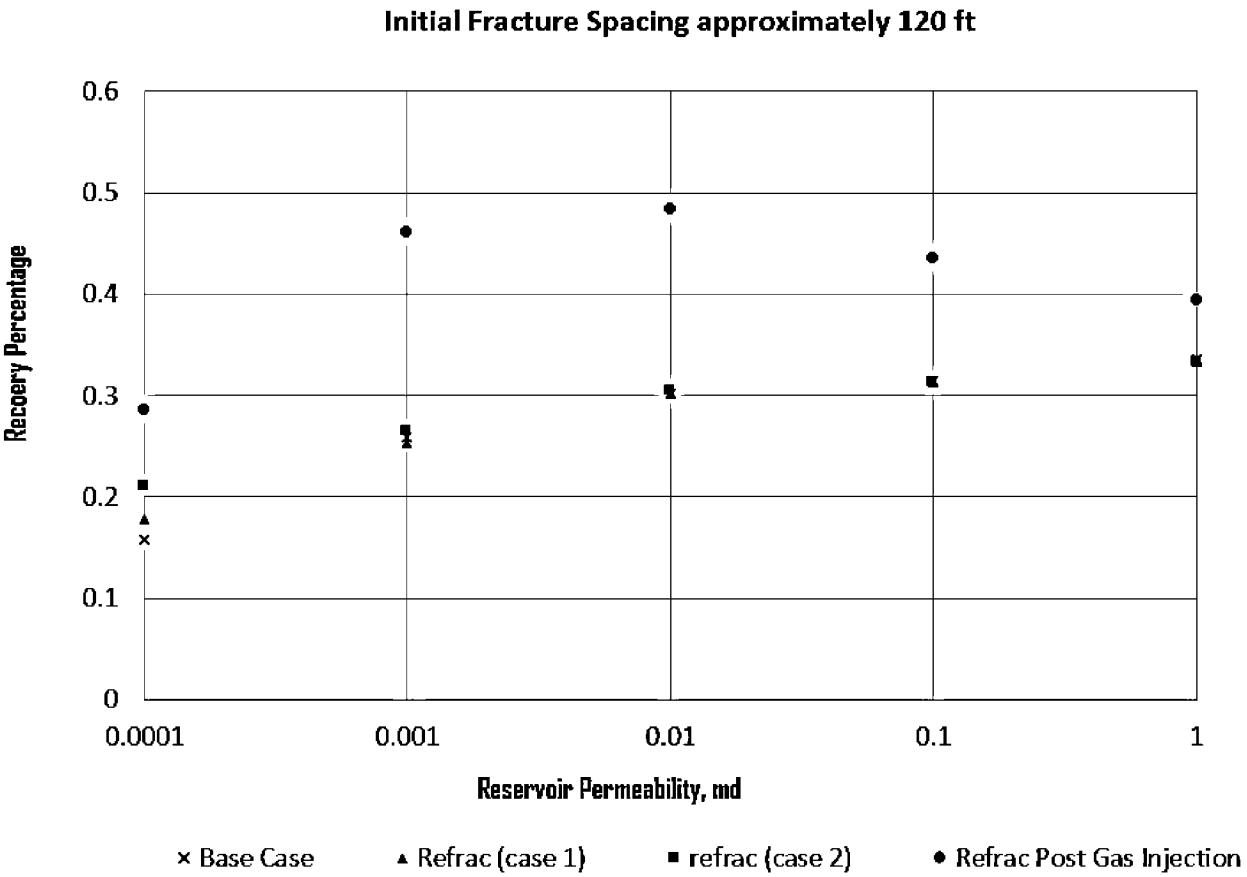
Figure 6C:
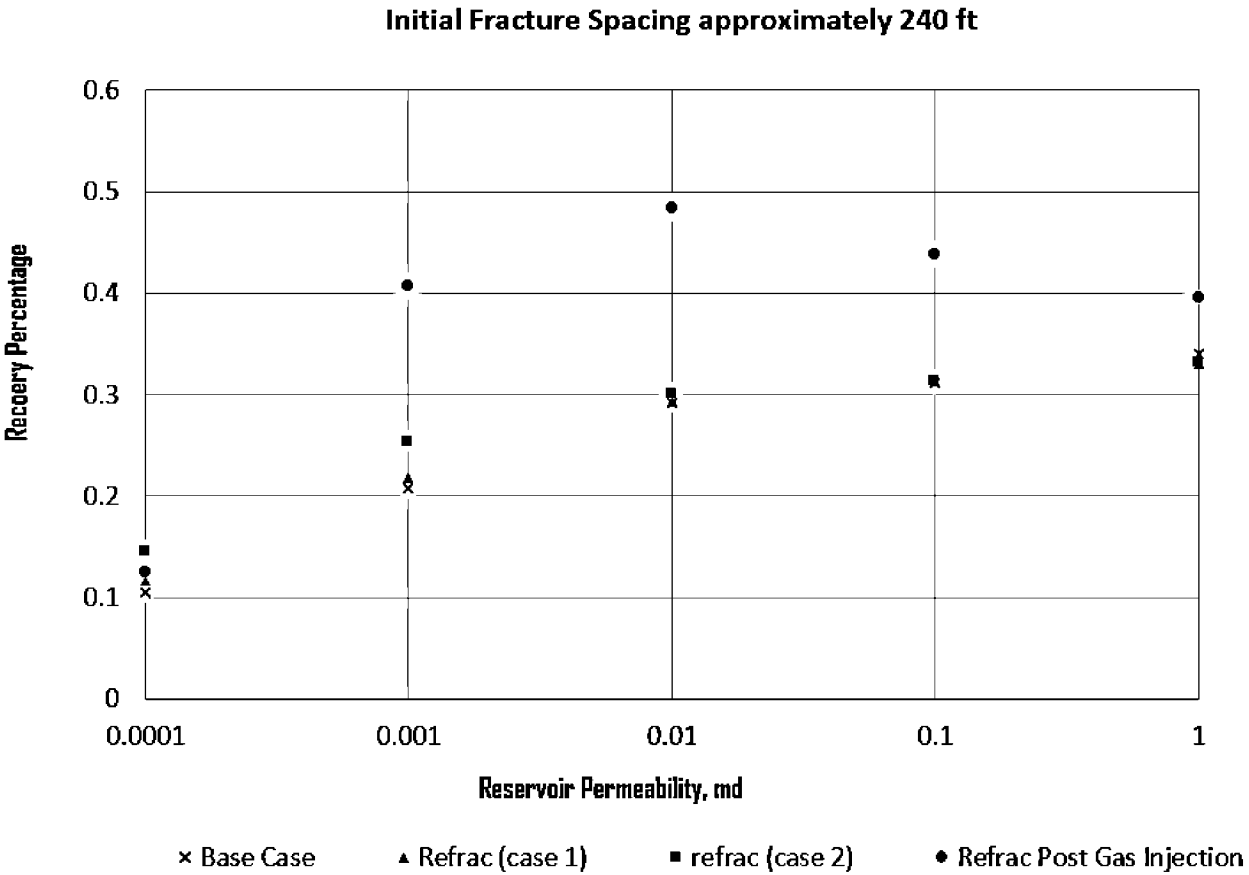
Figure 6D:
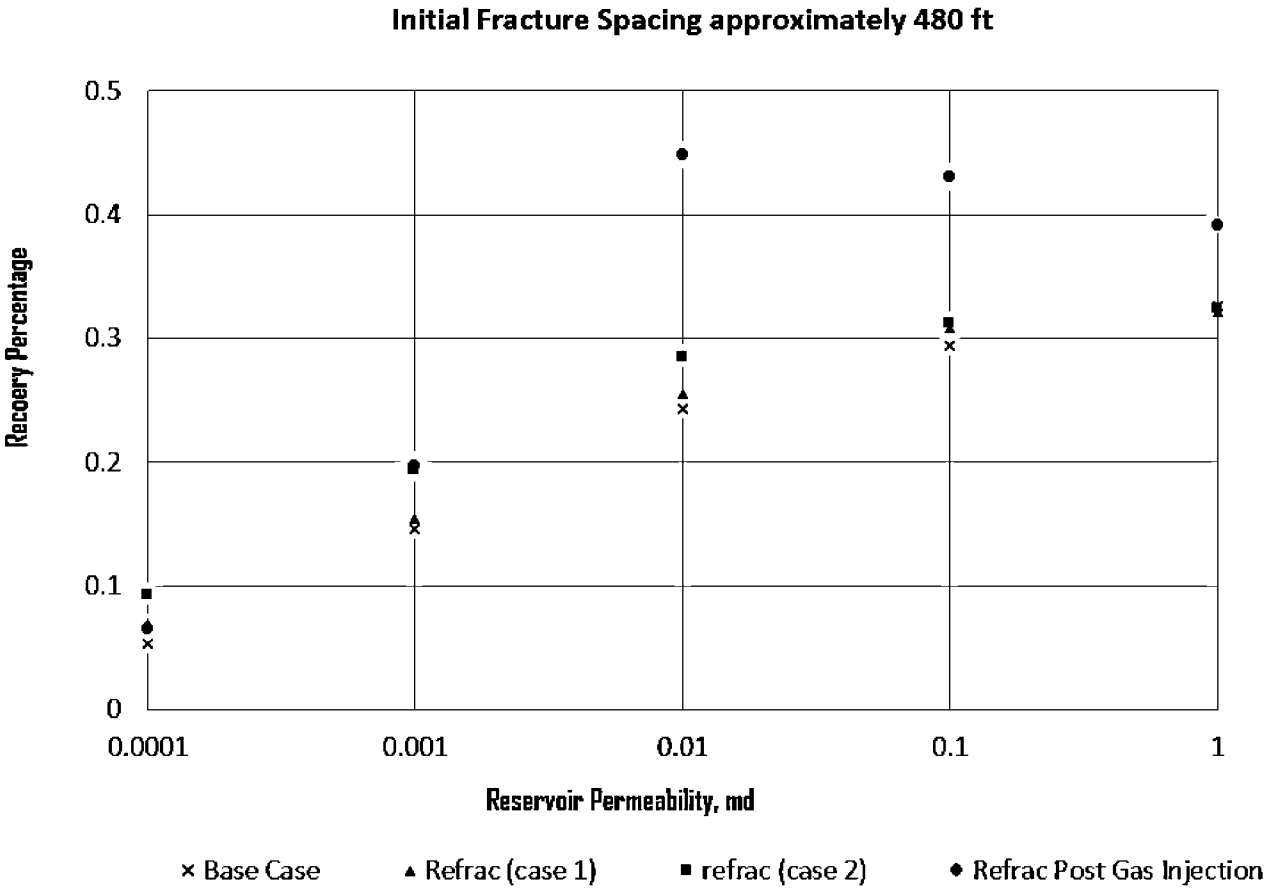
Figure 6E:
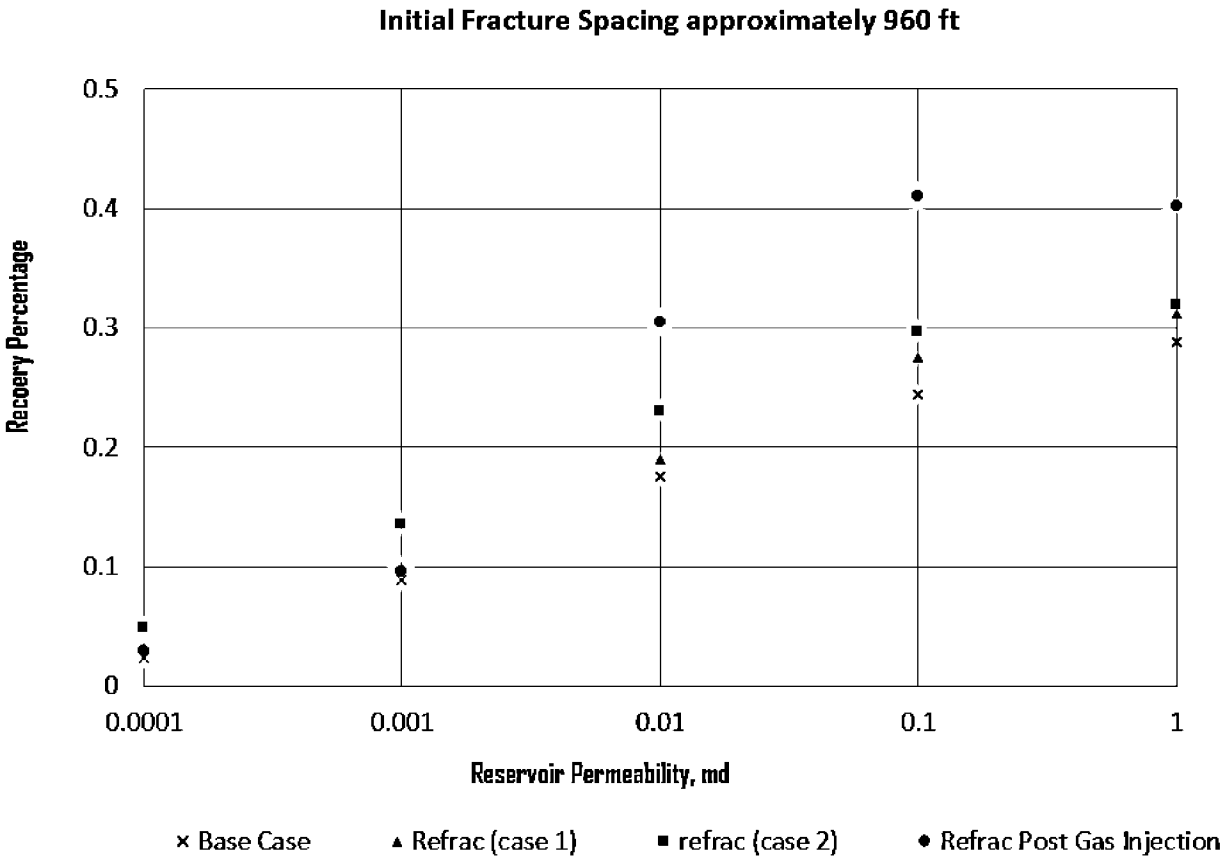

FIGS. 5A and 5B depict yet another option for restricting fluid communication between formation 30 and wellbore 26 via first fractures 34 (step 14). As shown, a fluid 82 can be pumped into wellbore portion 42 that enters and at least partially seals (e.g., by hardening) first fractures 34. Provided by way of example, fluid 82 can comprise a plugging gel, cement, a diverter, and/or the like. An illustrative such plugging gel is ZoneSafe™, available from Baker Hughes Incorporated. In some such methods, after fluid 82 at least partially seals first fractures 34, wellbore portion 42 can be cleaned and/or re-drilled to, for example, remove excess fluid 82 that has hardened.

The present methods can be at least partially simultaneously performed (e.g., step 10) on other wellbores in formation 30, which can increase the effectiveness of the formation's pressurization, at least by partially bounding such pressurization. The present methods, via pressurization of formation 30, can also facilitate completion of other wellbores into the formation by, for example, mitigating fracture driven interactions. Some of the present methods may be repeated on wellbore 26, with, for example, second fractures 46 deemed first fractures 34 at steps 10 and 14, new second fractures 46 being created at step 22, and the new second fractures being produced from at step 18.

EXAMPLES

The present invention will be described in greater detail by way of specific examples. The following examples are offered for illustrative purposes only and are not intended to limit the invention in any manner. Those of skill in the art will readily recognize a variety of noncritical parameters that can be changed or modified to yield essentially the same results.

Simulations were run to compare hydrocarbon recovery percentages from a wellbore using primary recovery from initial fractures of the wellbore ("Base Case"), post-primary recovery from new fractures of the wellbore after it is refractured ("Refrac"), and one of the present methods in which the initial fractures are pressurized via gas injection and isolated, the wellbore is refractured, and hydrocarbons are produced from the new fractures ("Refrac Post Gas Injection"). The Refrac simulation was performed with ("Case 2") and without ("Case 1") hydrocarbon production from the initial fractures in addition to hydrocarbon production from the new fractures; in an actual Refrac procedure, the hydrocarbon recovery percentage may be estimated by the Refrac simulation's hydrocarbon recovery percentages for either Case 1 or Case 2, depending on the design of the Refrac procedure.

Each of the Base Case, Refrac, and Refrac Post Gas Injection simulations was performed for initial fracture spacings of approximately 60, 120, 240, 480, and 960 ft. And for the Refrac and Refrac Post Gas Injection simulations, the new fractures were each placed between and equidistant from adjacent ones of the initial fractures, yielding a final fracture spacing between adjacent ones of the new and initial fractures that was smaller than the initial fracture spacing.

All of the simulations modeled a representative portion of the wellbore and surrounding formation located between adjacent ones of the fractures: between initial fractures for the Base Case simulation, and between an initial fracture and a new fracture for each of the Refrac and Refrac Post Gas Injection simulations. The performance of such a wellbore portion provides a good indicator for the performance of the wellbore, particularly as the number of fractures increases.

The resulting hydrocarbon recovery percentages are shown in FIGS. 6A-6E, as a function of formation permeability. As shown, at each initial fracture spacing, the Refrac Post Gas Injection simulation achieved significantly higher hydrocarbon recovery percentages than did the Base Case and Refrac simulations across a range of formation permeabilities. From this, it can be seen that Refrac Post Gas Injection is suited for increasing hydrocarbon recovery percentages from wellbores having initial fracture spacings of at least from 60 to 960 ft, and, as evidenced by the trends shown in FIGS. 6A-6E, wellbores having initial fracture spacings of from 30 (or less) to 2,000 (or more) ft.

As set forth in TABLE 1, below, the simulations also showed non-limiting combinations of initial fracture spacings and average formation permeabilities for which Refrac Post Gas Injection may especially increase the hydrocarbon recovery percentage from a wellbore.

TABLE 1

Exemplary Combinations of Initial Fracture Spacings and Average Formation Permeabilities for Refrac Post Gas Injection

| Average Formation Permeability (mD) | Initial Fracture Spacing (ft) | Final Fracture Spacing (ft) | Approximate Hydrocarbon Recovery Percentage Increase over Base Case ((Refrac Post Gas Injection %/Base Case %)-1) × 100% |
|---|---|---|---|
| 0.00005-0.0005 | 30-300 | 15-150 | 100% |
| 0.0005-0.005 | 30-600 | 15-300 | 100% |
| 0.005-0.05 | 30-1,500 | 15-750 | 65% |
| 0.05-0.5 | 30-2,000 | 15-1,000 | 50% |
| 0.5-5 | 30-2,000 | 15-1,000 | 30% |

The values in TABLE 1 may facilitate the selection of wellbores for Refrac Post Gas Injection.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A method of producing hydrocarbons from a formation, the method comprising:

pressurizing a formation by pumping fluid into a portion of a wellbore having one or more first fractures in fluid communication with the formation, wherein the fluid comprises a majority, by volume and/or mass, of a gas;

while the formation is pressurized, restricting fluid communication between the formation and the wellbore via the first fracture(s); and while fluid communication between the formation and the wellbore via the first fracture(s) is restricted:

creating one or more second fractures in the wellbore that are in fluid communication with the formation; and producing hydrocarbons from the formation via the second fracture(s).

2. The method of claim 1, wherein restricting fluid communication between the formation and the wellbore via the first fracture(s) is performed, at least in part, by disposing a tubular through the portion of the wellbore.

3. The method of claim 2, wherein the tubular comprises a casing or a liner.

4. The method of claim 3, wherein creating the second fracture(s) is performed, at least in part, by perforating the casing or liner.

5. The method of claim 3, wherein creating the second fracture(s) is performed, at least in part, by using a sliding sleeve of the casing or liner.

6. The method of claim 2, wherein:

packers are coupled to the tubular; and restricting fluid communication between the formation and the wellbore via the first fracture(s) is performed, at least in part, by setting the packers on opposing sides of the first fracture(s).

7. The method of claim 1, wherein restricting fluid communication between the formation and the wellbore via the first fracture(s) is performed, at least in part, by pumping a fluid into the portion of the wellbore that at least partially seals the first fracture(s).

8. The method of claim 1, wherein at least one of the second fracture(s) is disposed between adjacent ones of the first fracture(s) in a direction along the wellbore.

9. The method of claim 8, wherein a distance between the adjacent ones of the first fracture(s) is between 50 and 1000 feet (ft).

10. The method of claim 1, wherein, during pressurizing the formation and producing hydrocarbons from the formation, the fluid and the hydrocarbons flow through the wellbore or through a same tubular disposed within the wellbore.

11. The method of claim 1, wherein the portion of the wellbore is horizontal.

12. The method of claim 1, wherein the formation has an average permeability that is less than approximately 0.5 millidarcy (mD).

13. A method of producing hydrocarbons from a formation, the method comprising:

pressurizing a formation by pumping fluid into a portion of a wellbore having one or more first fractures that are in fluid communication with:

the formation: and one or more production sites in the wellbore via a flow path in the wellbore;

while the formation is pressurized, restricting fluid communication between the formation and the wellbore via the first fracture(s) at least by:

disposing a tubular through the portion of the wellbore, and/or setting packers that are coupled to a tubular on opposing sides of the first fracture(s); and while fluid communication between the formation and the wellbore via the first fracture(s) is restricted, producing hydrocarbons from the formation via one or more second. fractures of the wellbore that are in fluid communication with the formation and are disposed at the production site(s).

14. The method of claim 13, wherein at least one of the second fracture(s) is disposed between adjacent ones of the first fracture(s) in a direction along the wellbore.

15. The method of claim 13, wherein the tubular comprises a casing or a liner.

16. The method of claim 13, wherein:

during pressurizing the formation, pressure within the portion of the wellbore reaches a maximum pressure; and when fluid communication between the formation and the wellbore via the first fracture(s) is restricted, pressure within the portion of the wellbore is within 20% of the maximum pressure.

17. The method of claim 13, wherein the fluid comprises a majority, by volume and/or mass, of a gas.

18. The method of claim 13, wherein the portion of the wellbore is horizontal.

19. The method of claim 13, wherein the formation has an average permeability that is less than approximately 0.5 mD.

* * * * *